US006050191A

United States Patent [19]

Enderle et al.

[11] Patent Number: 6,050,191

[45] Date of Patent: Apr. 18, 2000

[54] SYSTEM AND METHOD FOR PROVIDING MULTI-PASS IMAGING IN A PRINTING SYSTEM

[75] Inventors: Ronald J. Enderle, Dayton; Russell L. Bartley, Urbana; James E. Knight, Dayton, all of Ohio

[73] Assignee: Scitex Digital Printing, Inc., Dayton, Ohio

[21] Appl. No.: 08/951,661

[22] Filed: Oct. 16, 1997

[51] Int. Cl.[7] ..... B41F 5/06

[52] U.S. Cl. ..... 101/222; 101/223; 101/221; 101/220

[58] Field of Search ..... 101/220, 221, 101/222, 223, DIG. 43

[56] References Cited

U.S. PATENT DOCUMENTS 3,835,775 9/1974 Benton ..... 101/151
3,906,855 9/1975 Laursen ..... 101/223
5,467,179 11/1995 Boeck et al. ..... 101/223
5,568,245 10/1996 Ferber et al. ..... 101/223
5,699,735 12/1997 Stein et al. ..... 101/220

*Primary Examiner*—John S. Hilten
*Assistant Examiner*—Daniel J. Colilla
*Attorney, Agent, or Firm*—Barbara Joan Haushalter

[57] ABSTRACT

A multi-pass imaging system and method provides for duplex documents and multiple color images with variable information to be printed by re-entering a substrate into a same tower system, employing a split roller design, for generating subsequent portions of a printed image. When a webbed substrate is fed into a tower, a first one in each of multiple pairs of rollers moves the substrate past a first set of printheads for generating a first portion of the printed image. The substrate is then re-entered into the tower, and a second one in each of the multiple pairs of rollers moves the substrate past a subsequent set of printheads for generating a subsequent portion of the printed image. Each of the multiple pairs of rollers comprise independently operating dual rollers on a single shaft.

7 Claims, 4 Drawing Sheets

SYSTEM AND METHOD FOR PROVIDING MULTI-PASS IMAGING IN A PRINTING SYSTEM

TECHNICAL FIELD

The present invention relates to electronic printing systems and, more particularly, to a system and method for passing a web through the same imaging system two or more times on high speed web presses for electronic printing.

BACKGROUND OF THE INVENTION

Electronic printing includes all ink jet printing, such as continuous ink jet printing, and all other systems wherein images are dried to fix the image on the substrate, as well as ionography, electrophotography, and all other systems wherein toner is fused to fix the image on the substrate. Current electronic printing presses are configured with a standard fuser/fixer or fixer/dryer system and are capable of drying at high speed, and full width.

Conventional printing presses arrange all the apparatus for printing in a tower. Paper is fed to the tower by appropriate paper feeding apparatus using either sheets of paper, or a continuous web of paper. Typical color printing presses utilize multiple "towers". The paper is fed sequentially from one tower to the next, each tower printing a particular color (or sometimes a transparent coating). For printing processes which require fixing of one color ink before the next color ink is printed, a standard fixer/dryer is used between towers.

When it is desired to print on both sides of a substrate, there are several options in common usage. In one common web press configuration the first side is printed in a first tower and then a second tower is used for printing on the reverse side. In this type configuration, a turnbar is required between towers. A turnbar is an arrangement of rollers which have the effect of inverting the web so that the unprinted side of the paper is available for printing in a subsequent tower. Typically, at least four colors are needed on each side of the paper, so eight towers are required. Obviously, the result is a long printing press, especially if dryers are required between print impressions. Long printing presses have associated problems which include excessive floor space requirements and, for digital printing systems, excessive data memory requirements.

Furthermore, when printing at high speeds with ink jet presses, a roller is needed on the unprinted side of the substrate to hold the web flat and close to the printhead, and the "wet" side of the substrate cannot be contacted immediately after printing.

Current designs to position the substrate under the printheads for imaging are often too big for some applications, and limited in application. Prior art designs were intended to serve traditional markets where floor space for the imager was not a primary concern. Duplex and second pass imaging was performed simply by adding another tower down stream of the first tower. This tandem arrangement could then image duplex documents or multiple colors with variable information.

It is seen, then, that there is a need for an improved electronic printing architecture whereby a webbed substrate could be fed into a single system tower when space consideration is a constraint, yet still provide duplex documents and printed images with multiple colors.

SUMMARY OF THE INVENTION

This need is met by the present invention which discloses a system and method whereby a webbed substrate is fed into a single system tower, imaged by a set of printheads, dried, and then re-entered into the same tower system under another set of heads, by employing a split roller system for transporting the substrate, for multiple pass imaging on either side of the same substrate.

In accordance with one aspect of the present invention, an electronic printing system comprises substrate supply means for supplying a substrate; and a split roller function for multiple passage of the substrate through the electronic printing system along a first paper path and at least one subsequent paper path in the same tower, to generate a printed image.

It is an object of the present invention to allow for multi-pass imaging of a web. It is another object of the present invention to provide a multi-pass imaging method which allows for drying between passes, data synchronization, and tension control. The present invention, therefore, provides the advantage of reducing overall imager size by eliminating multiple down stream towers, while still providing duplex documents and multiple colors with variable information.

Other objects and advantages of the invention will be apparent from the following description and the appended claims.

DETAILED DESCRIPTION OF THE INVENTION

The present invention is described in detail with particular reference to certain preferred embodiments thereof, but it will be understood that modifications and variations can be effected without departing from the spirit and scope of the invention.

Figure 1:
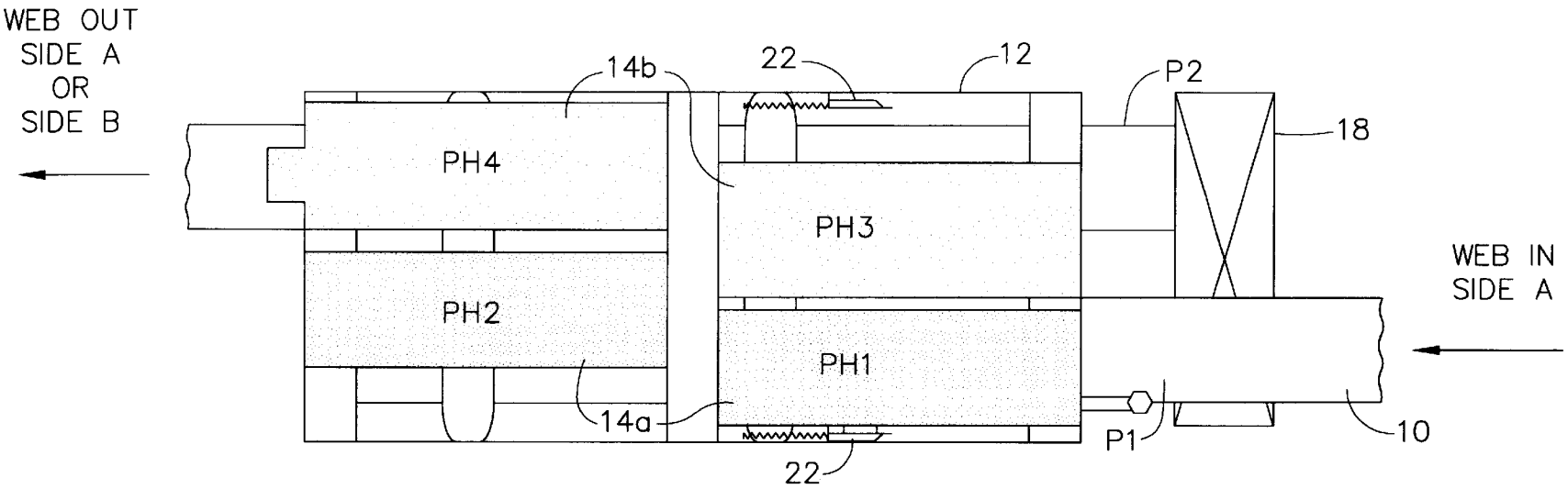
FIG. 1 illustrates a single tower multipass configuration in accordance with the present invention.

With space consideration as a constraint, the present invention proposes a method for multi-pass imaging, illustrated in FIG. 1. A webbed substrate 10 is fed into a single system tower 12, moved for imaging past a first set of printheads 14*a* by a first one in each pair of split rollers 20, dried at fixer/dryer unit 16 (see FIG. 4); and then re-entered into the same tower system 12, moved for second pass imaging under a second set of printheads 14*b* on either side of the same substrate 10 by a second one in each pair of split rollers 20. The split in the pairs of split rollers is indicated by line 19 in FIG. 3. The present invention, thereby, eliminates the requirement for a second tower to accommodate the second pass imaging, and the associated necessary floor space. Additionally, the same controller technology used in the tandem arrangement, and well known by those skilled in the art, can be employed to synchronize the variable data imaged on the first pass to that data positioned and imaged on the second pass.

In accordance with the present invention, the printheads 14*a* and 14*b* can be manually positioned over that part of the web 10 that is to be imaged. The positioning into sets 14*a* and 14*b* of the logically split printheads mounted on the tower 12 defines those used for first pass imaging, and those used for subsequent pass imaging.

Figure 2A:
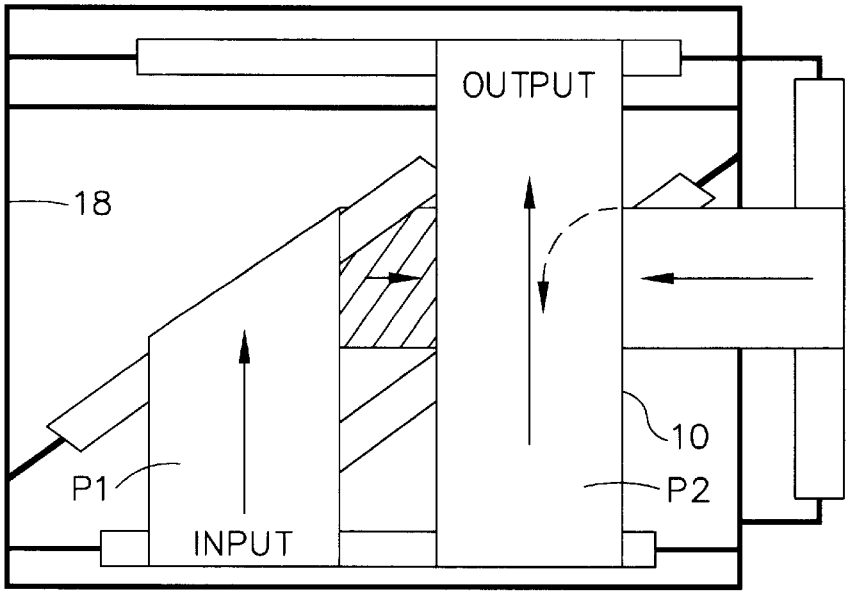
FIGS. 2A and 2B illustrate alternative turnbar configurations for moving the substrate through the multipass configuration of FIG. 1.
Figure 2B:
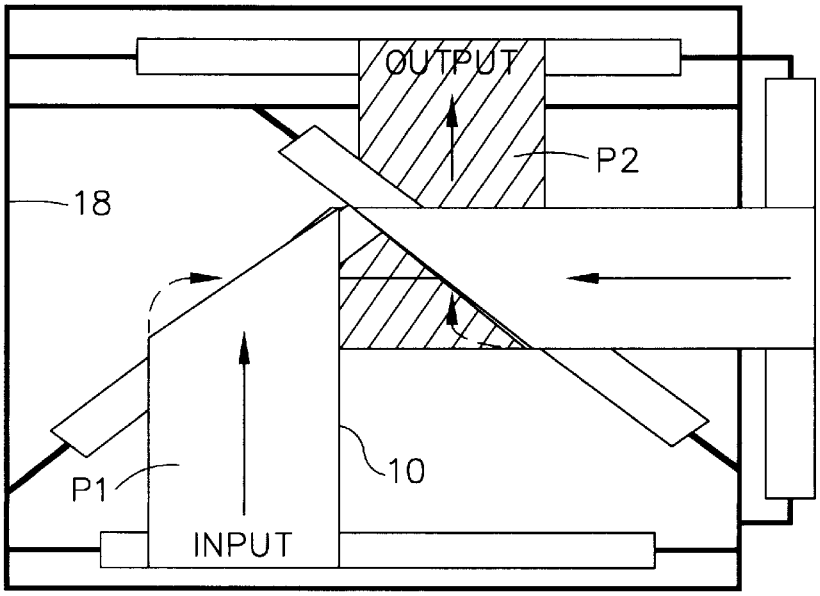

Referring now to FIGS. 2A and 2B, in a preferred embodiment of the present invention, positioning the web requires the use of a turnbar 18 incorporated into the tower system 12. The purpose of the turnbar 18 is to move the web 10, after a first imaging, to the other side of the tower 12, thereby positioning the web 10 under a subsequent set of printheads 14*b*. By configuring the turnbar 18, the web 10 can be either inverted for imaging on both sides of the substrate, as shown in FIG. 2B, or not inverted and additional imaging can be placed on the originally imaged side, as shown in FIG. 2A.

Figure 3:
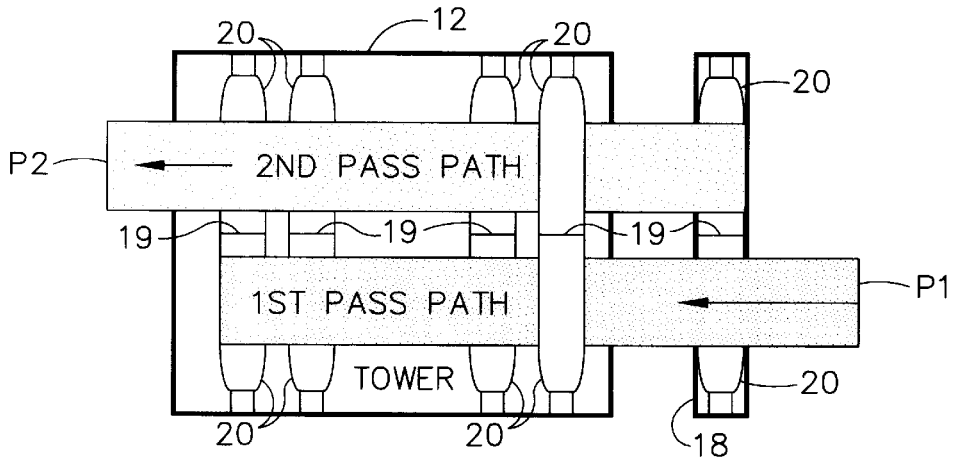
FIG. 3 is a top view of a single tower paper path, in accordance with the present invention.
Figure 4:
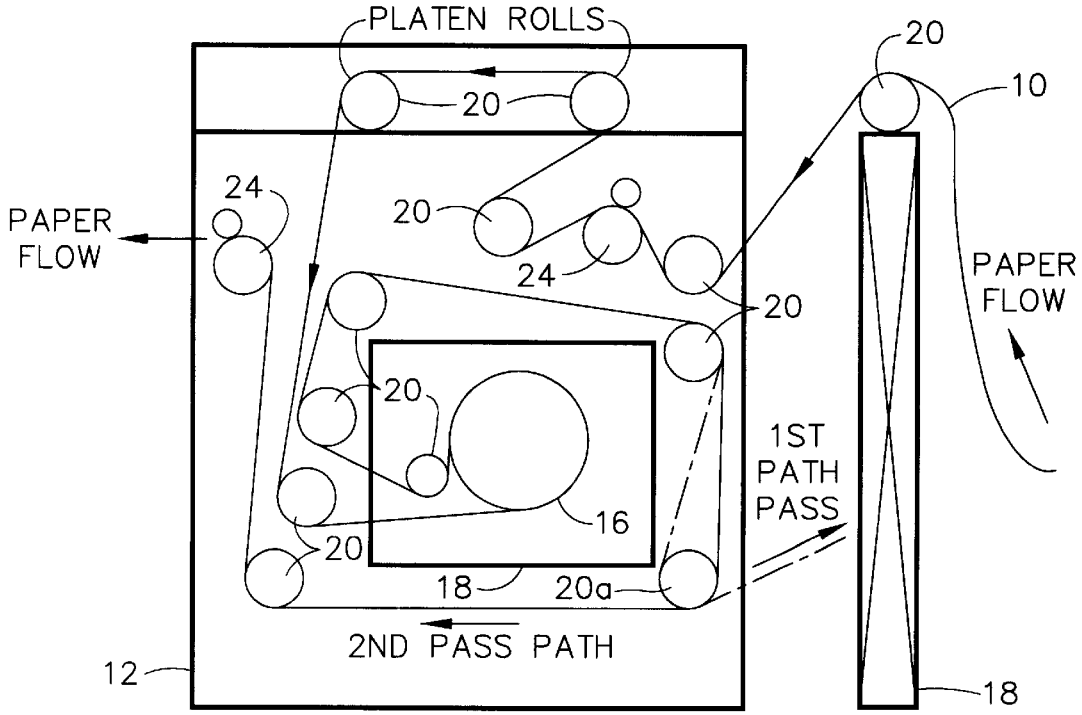
FIG. 4 is a side view of a single tower paper path, in accordance with the present invention.

For two pass imaging, the web 10 would be biased to one side or the other of the tower 12 by the operator during webbing. The substrate would then be webbed as shown in FIG. 3. As best illustrated in FIG. 4, at roller 20*a* immediately after the dryer unit 16, the web 10 would be strung through the turn bar 18 as illustrated in FIGS. 2A and 2B. At the exit of the turnbar, the web would re-enter the tower 12 and follow the path shown in FIG. 3, which is a parallel path to the original pass. Each of the dual rollers 20 along the web paths P1 and P2, which includes all of the rollers with the exception of the drive rollers 24 (since drive rollers 24 are not split rollers), is independent of the other roller on the same shaft.

With the dual roller system of the present invention, whereby a pair of rollers are mounted on the same shaft, the paths P1 and P2 can be identical and yet let the webs act independently, allowing for instantaneous speed or tension differences, as best illustrated in FIG. 4. This split roller function allows for the necessary and critical accurate image positioning. In the platen roller system, the split rollers allow for the incorporation of two separate encoders, so each printhead set 14*a* and 14*b* has its own encoder 22 to insure accurate imaging.

Figure 5:
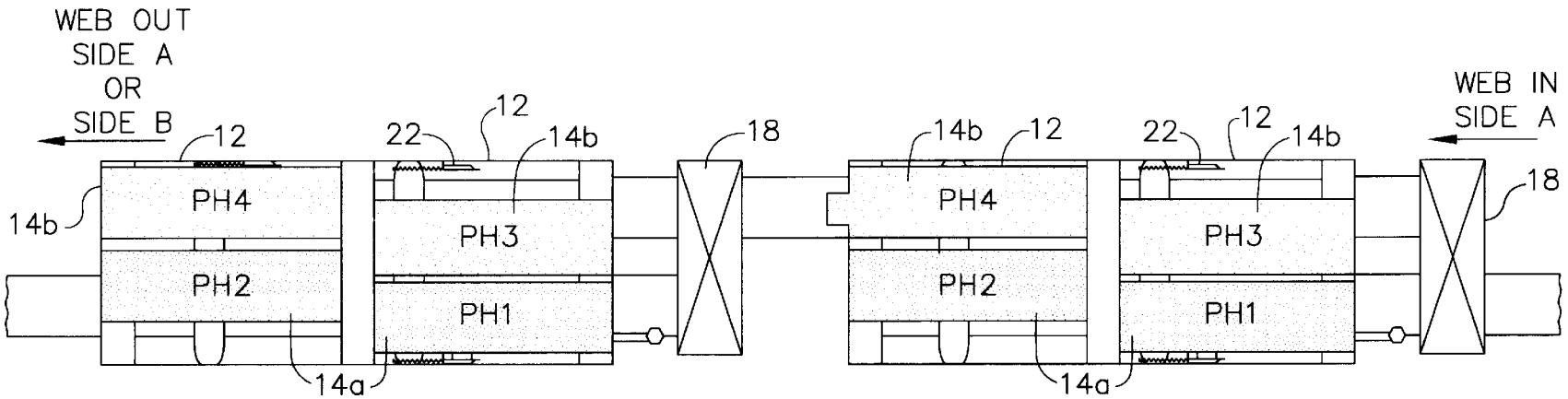
FIG. 5 is an alternative embodiment of the multipass configuration of the present invention, showing a dual tower configuration.

For multiple passes, or for multiple colors or images, this tower configuration can also be placed in tandem. As explained above, in the single tower configuration, passing the web through twice without inverting allows multiple colors or images to be placed on the same side of a substrate, Side A. If no other imaging is to take place on the opposing side, Side B, the imaging process is complete. However, in many applications, synchronized imaging is required on both sides of the substrate. The design of the tower 12 and associated controls, as known in the art, are such that a second tower 12 can be placed down stream of the original tower and successive images can be placed on the web, as illustrated in FIG. 5. In FIG. 5, as in the single tower configuration, the down stream system 12 can also invert or not invert the web, depending on the desired configuration.

Industrial Applicability and Advantages

The present invention is useful in the field of electronic printing, and has the advantage of allowing for multi-pass imaging through the same split/dual rollers. The present invention provides the further advantage of minimizing the space requirements for an electronic printer, while still allowing imaging of duplex documents or multiple colors. It is another advantage of the present invention that it provides full duplex imaging with multiple passes on each side of the web. It is a further advantage of the present invention that drying between passes, data synchronization, and tension control are also accommodated during the passes.

The invention has been described in detail with particular reference to certain preferred embodiments thereof, but it will be understood that modifications and variations can be effected within the spirit and scope of the invention.

What is claimed is:

1. A printing system comprising:

substrate supply means for supplying a substrate;

at least one tower for receiving the substrate;

a first plurality of printheads in a first one of the at least one tower;

means for controllably transporting the substrate through the printing system past the first plurality of printheads to generate a first portion of a printed image;

at least one subsequent plurality of printheads in the first one of the at least one tower; and means for controllably transporting the substrate through the printing system past the at least one subsequent plurality of printheads in the first one of the at least one tower to generate at least one subsequent portion of the printed image, wherein the means for controllably transporting the substrate through the printing system past the first plurality of printheads comprises a split roller system, incorporating independently operating multiple pairs of rollers, each pair of rollers on a single shaft.

2. A printing system as claimed in claim 1 wherein the means for controllably transporting the substrate through the printing system past the at least one subsequent plurality of printheads comprises a split roller system, incorporating independently operating multiple pairs of rollers, each pair of rollers on a single shaft.

3. A multi-pass imaging method comprising the steps of:

feeding a webbed substrate into a printing tower;

providing multiple pairs of rollers having independently operating dual rollers on a shared shaft;

employing a first one in each of the multiple pairs of rollers to move the substrate past a first set of printheads for generating a first portion of a printed image;

re-entering the substrate into the printing tower; and employing a second one in each of the multiple pairs of rollers to move the substrate past a subsequent set of printheads for generating a subsequent portion of the printed image.

4. A multi-pass imaging method as claimed in claim 3 further comprising the step of drying the first portion of the printed image prior to the step of re-entering the substrate in the printing tower.

5. A multi-pass imaging method as claimed in claim 3 further comprising the step of using a turnbar to position the web for feeding the substrate into the printing tower.

6. A multi-pass imaging method as claimed in claim 5 further comprising the step of biasing the web to one side to achieve two pass imaging.

7. A multi-pass imaging method as claimed in claim 3 further comprising the step of inverting the web for imaging on both sides of the substrate.

* * * * *